US009212642B2

(12) United States Patent
Petersen

(10) Patent No.: US 9,212,642 B2
(45) Date of Patent: Dec. 15, 2015

(54) FUEL RAIL-COOLED ENGINE CONTROL SYSTEM

(71) Applicant: MSD, LLC, El Paso, TX (US)

(72) Inventor: Todd Petersen, Scottsdale, AZ (US)

(73) Assignee: MSD LLC, El Paso, TX (US)

( * ) Notice: Subject to any disclaimer, the term of this patent is extended or adjusted under 35 U.S.C. 154(b) by 331 days.

(21) Appl. No.: 13/707,276

(22) Filed: Dec. 6, 2012

(65) Prior Publication Data

US 2014/0158091 A1 Jun. 12, 2014

(51) Int. Cl.
*F02M 69/46* (2006.01)
*F02M 53/04* (2006.01)

(52) U.S. Cl.
CPC ..... *F02M 69/46* (2013.01); *F02M 53/043* (2013.01); *F02M 2700/4359* (2013.01)

(58) Field of Classification Search
CPC ..... F02M 69/46; F02M 53/043; F02M 2700/4359
USPC ..... 123/456, 647, 41.31, 41.32
See application file for complete search history.

(56) References Cited

U.S. PATENT DOCUMENTS 4,570,601 A * 2/1986 Ito et al. ..... 123/468
4,791,569 A 12/1988 Suzuki
4,893,590 A * 1/1990 Kashimura et al. ..... 123/41.31
5,086,743 A * 2/1992 Hickey ..... 123/468
5,178,115 A * 1/1993 Daly ..... 123/470
5,211,149 A * 5/1993 DeGrace, Jr. ..... 123/470
5,347,969 A * 9/1994 Gmelin et al. ..... 123/456
5,363,825 A * 11/1994 Becker ..... 123/456
5,471,961 A * 12/1995 McArthur et al. ..... 123/456
5,568,798 A * 10/1996 Lorraine ..... 123/456
5,584,704 A * 12/1996 Romann et al. ..... 439/130
5,718,206 A * 2/1998 Sawada et al. ..... 123/470
6,186,106 B1 * 2/2001 Glovatsky et al. ..... 123/143 C
6,341,967 B1 * 1/2002 Nabeshima et al. ..... 439/130
6,564,775 B1 * 5/2003 Kikuta et al. ..... 123/456
6,666,190 B1 * 12/2003 DiMaria et al. ..... 123/470
6,675,755 B2 * 1/2004 Glovatsky et al. ..... 123/143 C
7,340,630 B2 3/2008 Morris et al.

* cited by examiner

*Primary Examiner* — Hai Huynh
(74) *Attorney, Agent, or Firm* — Standley Law Group LLP

(57) ABSTRACT

A method for cooling an ECU and an ECU or ECU module mounted to be cooled by fuel flow through a fuel rail. In a preferred embodiment, the ECU has a decentralized distributed processing configuration, with a main ECU module and at least one remote module. The remote ECU module is packaged in an assembly with an elongate hollow metal fuel rail having injector seats. Fuel injectors are received into and seal against the seats and are supplied with fuel via the fuel rail. A printed circuit board carries electronic ECU components. One or more connector assemblies are connected to printed circuit board for electrically connecting the ECU circuitry and may pass through notches formed in the fuel rail. The electronics are potted and mounted to the fuel rail. A thermally conductive wetting compound may be disposed between the electronic assembly and the fuel rail.

11 Claims, 2 Drawing Sheets

FUEL RAIL-COOLED ENGINE CONTROL SYSTEM

BACKGROUND OF THE INVENTION

1. Field of the Invention

This invention relates generally to engine control systems for internal combustion engines, and in particular to a method and system for cooling electronic components thereof.

2. Background Art

Today's automotive internal combustion engines are now almost universally computerized distributorless or direct ignition, fuel injection engines. Such an engine includes a computerized control system, commonly known as an engine control unit (ECU), which controls fuel injection, ignition, and typically other various engine and automotive systems as preprogrammed functions of numerous signals received from various sensors. One or more driver circuits amplify and condition the controls signals to be suitable for use with the fuel injection and ignition components.

Fuel injection systems use one or more fuel injectors, which are electromechanical devices that meter and atomize fuel. In each injector, application of an electrical current to a coil lifts a spring-loaded needle within a pintle valve off its seat, thereby allowing fuel under pressure to be sprayed through an injector nozzle to form a cone pattern of atomized fuel.

Fuel injection systems may be classified as single point, multi-point, or direct injection. In multi-point configurations, there are generally as many fuel injectors as there are cylinders, and the fuel injectors dispense fuel into the induction manifold near their associated intake valves. A fuel rail (a manifold so called because of its rail-like shape) is typically used to deliver fuel to individual fuel injectors. The fuel rail has a number of seats formed therein. Each injector is received into and seals against its seat. The fuel rail has an inlet port, and possibly a filter, a cross-over port, an attached fuel pressure regulator and/or a fuel pressure sender.

Distributorless or direct ignition systems use a crankshaft sensor that provides a trigger signal to the ECU, which triggers the correct channel and timing of the ignition. An individual coil per cylinder, coil packs with multiple secondary terminals, or a common coil configuration may used. The coil(s) are selectively switched to an energy source through a driver that is triggered by the ECU. These drivers are sometimes incorporated into the ECU, and other times in the coils themselves.

To minimize cost, original equipment manufacturers (OEM) of automobile collocate the ECU microprocessor and driver circuits in a single assembly, often on a single printed circuit board. The ECU is typically mounted at a distance from the engine—under the dashboard in the cabin, on the firewall, or elsewhere in the engine compartment, for example. The ECU is typically encapsulated by an epoxy potting compound within a finned metal housing, which radiates heat generated by the electronic components into the atmosphere. The numerous control outputs and sensor inputs are routed within a large vehicle harness assembly.

As ECUs become more advanced, monitoring more parameters and controlling more systems with greater sophistication and speed, processor computational demands increase. This trend, coupled with continued miniaturization of semiconductor technology, results in more localized heat being generated by ECUs and concomitant shorter mean time between failures for ECUs.

3. Identification of Objects of the Invention

A primary object of the invention is to provide an engine control unit having superior cooling for increased reliability.

Another object of the invention is to provide a method of liquid cooling for electronic components using the fuel system as a heat sink.

Another object of the invention is to provide an ECU for engine control with superior aesthetic appeal.

SUMMARY OF THE INVENTION

The objects described above and other advantages and features of the invention are incorporated in a method for cooling an ECU and an ECU or an ECU module mounted so as to be in thermal communication with a fuel injection fuel rail, thereby being in close proximity to the fuel injectors and the ignition components controlled by the ECU and being cooled by the fuel flow, which acts as a heat sink.

In a preferred embodiment, the ECU has a decentralized distributed processing configuration, with a main ECU module and at least one remote module. The remote ECU module is packaged in an assembly with a fuel rail manifold. The fuel rail is an elongate hollow metal member formed with a number of seat formed therein. Fuel injectors are received into and seal against the seats and are supplied with fuel via the fuel rail.

The remote module includes a printed circuit board that carries electronic components required for actuating fuel injectors and ignition coils. One or more connector assemblies are connected to printed circuit board for electrically connecting the circuitry to the main engine control module, the ignition coils, the fuel injectors, and/or other sensors. The fuel rail has a profile which may include cut-outs or notches through which these connectors may pass.

The remote ECU module is ideally potted within a cup, and the potted assembly is mounted to the fuel rail. A layer of thermal grease, thermal gel or other thermal pad 65 is preferably disposed between electronic assembly and the fuel rail so that heat generated within the electronic circuitry is transferred into fuel rail manifold. Fuel passing through the fuel rail removes heat from the electronics.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
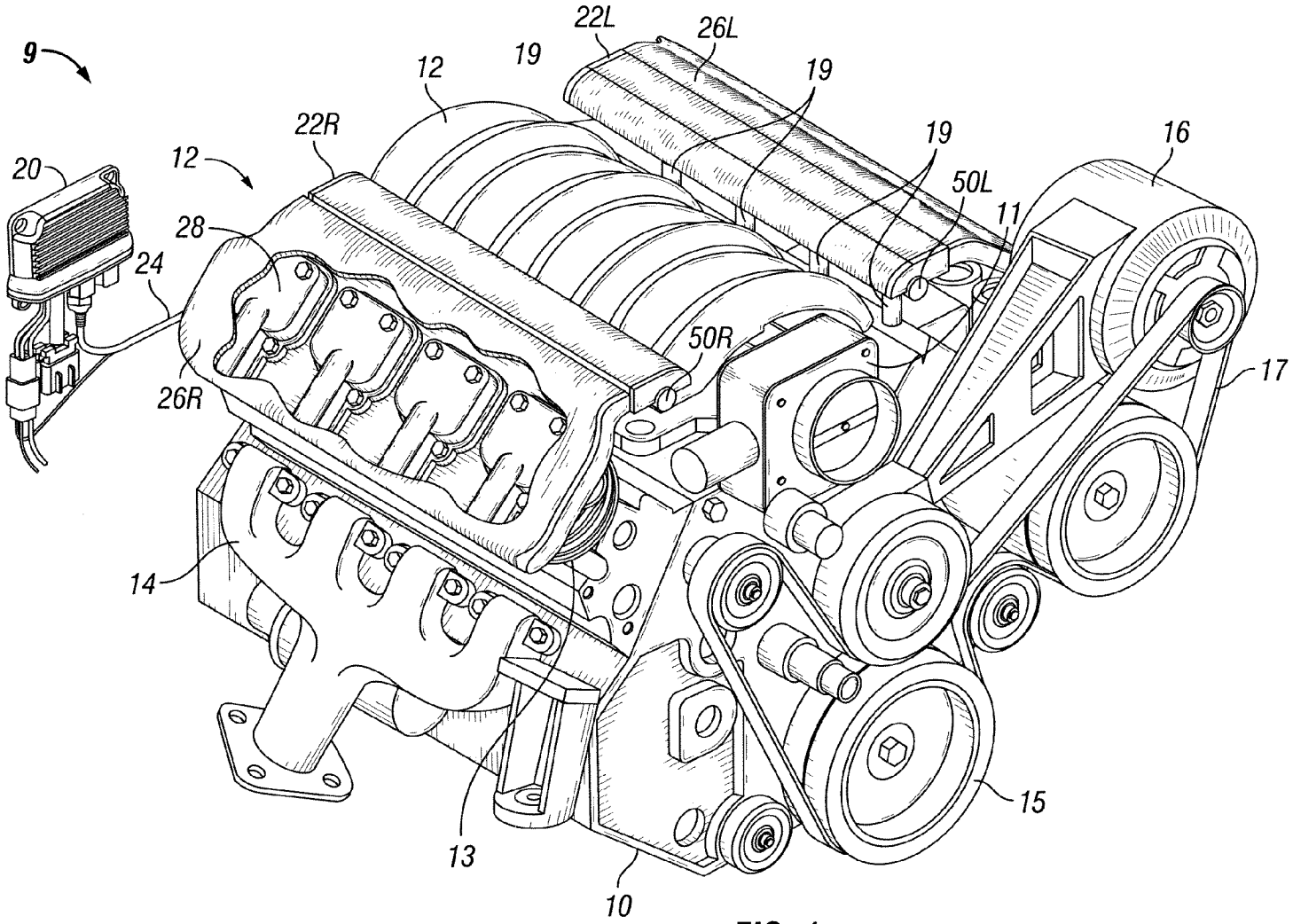
FIG. 1 is a perspective view of an internal combustion engine equipped with a decentralized engine control system /, showing a main ECU located at a distance from the engine that is interconnected with left and right bank remote modules mounted atop the engine adjacent to their controlled injectors and ignition coils.

FIG. 1 is a simplified illustration of a modern automotive internal combustion V-8 engine 9 equipped with a multi-point fuel injection system and a computerized ignition system.

Although the invention is described with respect to a V-8 engine, it may be used with any engine having a suitable configuration.

Clearly visible in FIG. 1 are the engine block 10, throttle body 11, induction, or intake, manifold 12, right-side valve cover 13, right-side exhaust manifold 14, crankshaft flywheel 15, alternator 16, serpentine belt 17, and other various parts as is known in the art. Four fuel injectors 19 are connected between the induction manifold 12 and a left-side fuel rail 50L. Similarly, four fuel injectors 19 (not visible) are connected between the induction manifold 12 and a right-side fuel rail 50R.

Engine 9 is shown configured with an ignition system arrangement that employs an individual coil 28 per cylinder, although other ignition coil systems may equally be used. Four coils 28 are disposed above each valve cover and are covered by a protective shroud. A portion of right shroud 26R is shown cut away to reveal the coils 28.

In a preferred embodiment, engine 9 is controlled by a decentralized ECU that uses distributed processing. A decentralized ECU separates the main processor from injector and ignition drivers, power drivers, and various sensor inputs, thereby allowing smaller ECU input/output subsystems to be located near the ignition and fuel injection components. Such an arrangement minimizes the electrical harness requirements, which is particularly desirable for aftermarket fuel injection and/or ignition retrofit products due to its installation simplicity. Some enthusiasts also feel that a decentralized ECU has aesthetic advantages over the traditional centralized ECU. Although the present invention is particularly well-suited for use with a decentralized distributed processing ECU, it may equally be used with a centralized ECU or an ECU having some type of hybrid configuration.

As shown in FIG. 1, the decentralized ECU includes a main ECU module 20 and left and right bank remote input/output modules 22L, 22R. Each remote module includes one or more input channels for sensor inputs, four ignition outputs, and four fuel injector outputs. Additionally, each remote module may optionally include a number of other outputs, which may be used for electronic throttle control, variable valve timing, or idle air motor actuation, for example. A bidirectional ECU control bus 24 operatively connects main ECU 20 to left and right bank remote modules 22L, 22R, for example, as described in co-pending U.S. patent application Ser. No. 13/570,041, filed on Aug. 8, 2012 in the name of Eisenbarth et al. and entitled "Engine Control Using an Asynchronous Data Bus," which is incorporated herein in its entirety by reference. As described in greater detail below, remote modules 22L, 22R are each mounted atop fuel rails 50L, 50R and adjacent to shrouds 26L, 26R, respectively, so that they are close to the fuel injectors 19 and the ignition coils 28 that they control. The fuel rails 50L, 50R are thermally coupled to modules 22L, 22R, and the fuel flow through the rails acts as a heat sink to cool the electronic components of the remote modules.

Figure 2:
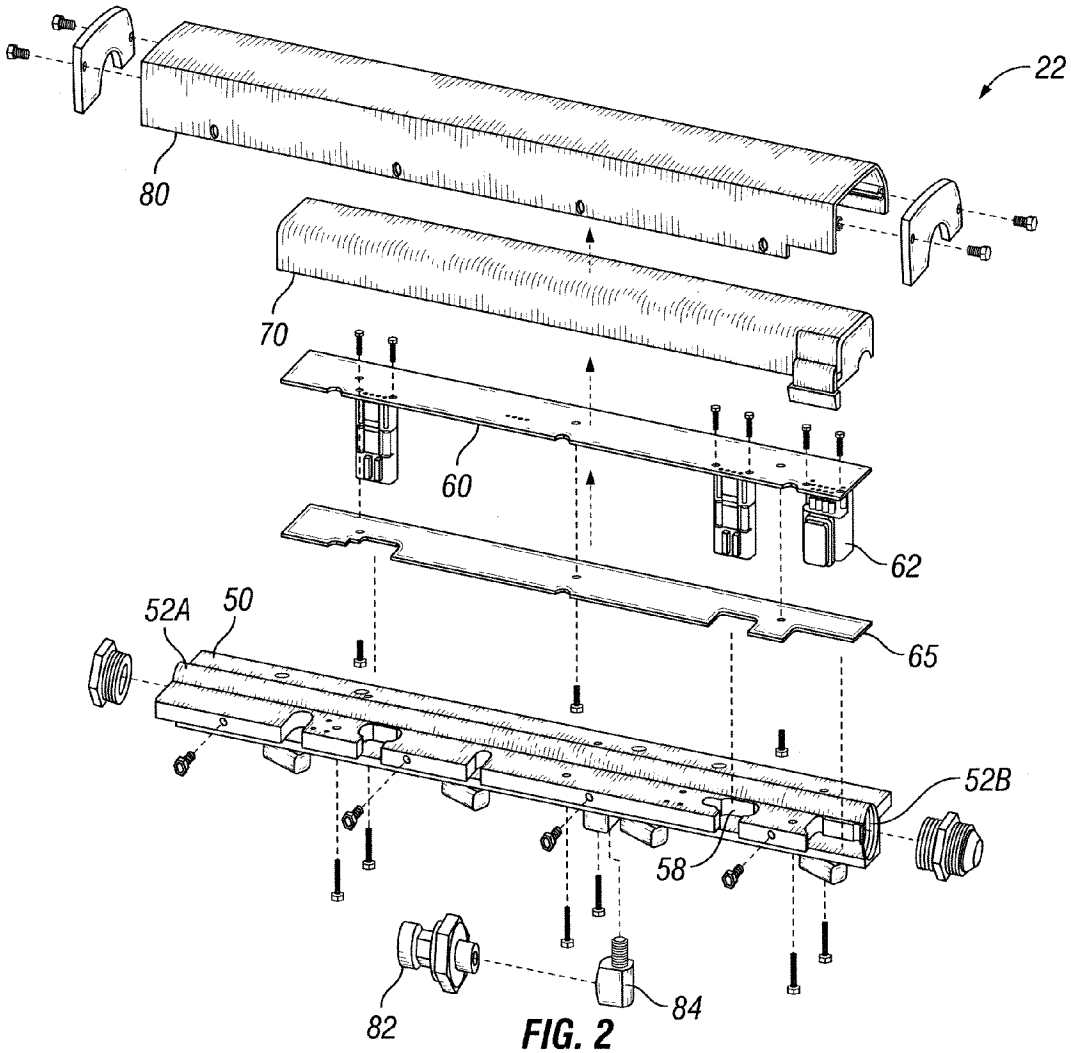
FIG. 2 is an exploded perspective diagram of a remote module of the engine control system of FIG. 1, showing detail of the electronic circuit components being carried by and thermally coupled to a fuel distribution manifold for cooling of the components according to a preferred embodiment of the invention.

FIG. 2 is an exploded diagram that illustrates a remote module 22 according to a preferred embodiment of the invention. Remote module 22 is included in an assembly with fuel rail manifold 50. Fuel rail 50 is preferably made of aluminum, brass or other non-ferrous metal. Fuel manifold 50 is an elongate member having a length generally corresponding to the length of the engine block for which it is designed. It has a hollow interior with ports 52A, 52B at each of its distal ends. One of the ports 52B is used as a fuel inlet, whereas the other port 52A is typically plugged, although it can be used for a cross-over connection with the opposite remote module assembly 22. Four bosses 54 are formed at the bottom of fuel manifold 50. Each boss 54 has a seat into which an injector 19 (FIG. 1) is received. The bosses 54 are in fluid communication with the interior of the fuel manifold 50 and serve to provide gasoline to the fuel injectors 19.

Remote module 22 includes a printed circuit board 60 that carries electronic components required for actuating fuel injectors and ignition coils as appropriate. As such electronic circuitry is known in the art, it is not discussed further herein. Printed circuit board 60 preferably uses surface mount technology, although other mounts may be used as appropriate. Connected to printed circuit board 60 are one or more connector assemblies 62, which are used to couple the circuitry to the main engine control module 20, the ignition coils 28, the fuel injectors, and/or other sensors. Fuel rail manifold 50 has a profile that includes cut-outs or notches 58 through which connectors 62 may pass.

Printed circuit board 60 is enclosed within a potting cup 70. Encapsulating epoxy resin (not illustrated) is poured and cured about printed circuit board 60 within cup 70 to make a watertight sealed assembly. As potting is well known in the art, it is not discussed further herein. Printed circuit board 60, once potted and encapsulated within cup 70, is mounted to fuel rail 50. A layer of thermal grease, thermal gel or other thermal pad 65 is preferably disposed between printed circuit board 60 and fuel rail 50 so that heat generated within the electronic circuitry is transferred into fuel rail manifold 50. Fuel passing through manifold 50 removes heat from printed circuit board 60 thereby cooling electronic circuitry. A cover 80 completes the assembly, offering aesthetic beauty and protection. Additionally, a fuel pressure sender 82 is in fluid communication with the interior of fuel manifold 50 via a brass elbow fitting 84.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. An engine control system for a fuel injected internal combustion engine comprising:

electronic circuitry operatively coupled to an ignition system and a fuel injection system of said engine, said electronic circuitry comprising an injector driver and an ignition driver; and a fuel rail manifold adapted for connection to a plurality of fuel injectors for supplying said engine with fuel;

said electronic circuitry being thermally coupled to said fuel rail manifold; whereby fuel flow through said fuel rail manifold cools said electronic circuitry.

2. The engine control system of claim 1 further comprising:

a printed circuit board carrying said electronic circuitry;

a connector mounted to said printed circuit board and operatively connected to said electronic circuitry; and a notch formed in said fuel rail manifold through which said connector passes.

3. The engine control system of claim 2 wherein:

said printed circuit board is mounted to said fuel rail manifold.

4. The engine control system of claim 1 further comprising:

a potting compound encapsulating said electronic circuitry.

5. The engine control system of claim 1 further comprising:

a thermally conductive wetting substance disposed between said electronic circuitry and said fuel rail manifold for facilitating heat transfer.

6. An engine control system for a fuel injected internal combustion engine comprising:

a main engine control module;

a first remote engine control module comprising an injector driver, an ignition driver, a power driver and a plurality of sensor inputs, said main engine control module and said first remote engine control module arranged to collectively control a first ignition component and a first fuel injector; and a first fuel rail manifold adapted for connection to said first fuel injector for supplying said engine with fuel;

said first remote engine control module being mounted to and thermally coupled with said first fuel rail manifold; whereby fuel flow through said first fuel rail manifold cools said first remote engine control module; and whereby said first remote engine control module is located near to said first ignition component and said first fuel injector.

7. The engine control system of claim 6 wherein:

said main engine control module is mounted at a location away from said engine.

8. The engine control system of claim 6 further comprising:

a second remote engine control module, said main engine control module and said second remote engine control module arranged to collectively control a second ignition component and a second fuel injector;

a second fuel rail manifold adapted for connection to said second fuel injector for supplying said engine with fuel;

said second remote engine control module being mounted to and thermally coupled with said second fuel rail manifold; whereby fuel flow through said second fuel rail manifold cools said second remote engine control module; and whereby said second remote engine control module is located near to said second ignition component and said second fuel injector.

9. A method for cooling an engine control unit of an fuel-injected internal combustion engine, said engine control unit including electronic circuitry for controlling an ignition system and a fuel injection system of said engine, the method comprising the steps of:

providing a fuel rail manifold;

fluidly coupling said fuel rail manifold to a fuel injector for supplying fuel to said engine; and locating at least a portion of said electronic circuitry so as to be in thermal contact with said fuel rail manifold, wherein said at least a portion of said electronic circuitry comprises an injector driver, an ignition driver, a power driver and a plurality of sensor inputs, whereby fuel flow through said fuel rail manifold cools said at least a portion of said electronic circuitry.

10. The method of claim 9 further comprising the steps of:

carrying said at least a portion of said electronic circuitry on a printed circuit board;

mounting a connector that is operatively connected to said at least a portion of said electronic circuitry to said printed circuit; and providing a notch in said fuel rail manifold; and mounting said printed circuit board to said fuel rail manifold, wherein said connector passes through said notch.

11. The engine control system of claim 9 further comprising the step of:

disposing a thermally conductive wetting substance between said at least a portion of said electronic circuitry and said fuel rail manifold for facilitating heat transfer.

* * * * *